US006137453A

United States Patent [19]

Wang et al.

[11] Patent Number: 6,137,453

[45] Date of Patent: Oct. 24, 2000

[54] BROADBAND MINIATURIZED SLOW-WAVE ANTENNA

[75] Inventors: Johnson J. H. Wang, Marietta; James K. Tillery, Woodstock, both of Ga.

[73] Assignee: Wang Electro-Opto Corporation, Marietta, Ga.

[21] Appl. No.: 09/197,325

[22] Filed: Nov. 19, 1998

[51] Int. Cl.[7] ..... H01Q 1/36

[52] U.S. Cl. ..... 343/895; 343/700 MS

[58] Field of Search ..... 343/731, 872, 343/700 MS, 895, 792.5

[56] References Cited

U.S. PATENT DOCUMENTS

| | | | |
|---|---|---|---|
| 4,095,227 | 6/1978 | Kaloi | 343/700 MS |
| 4,937,585 | 6/1990 | Shoemaker | 343/700 MS |
| 5,313,216 | 5/1994 | Wang et al. | 343/700 MS |
| 5,621,422 | 4/1997 | Wang | 343/895 |
| 5,623,271 | 4/1997 | Ponnapalli | 343/895 |
| 5,661,494 | 8/1997 | Bondyopadhyay | 343/700 MS |
| 5,712,647 | 1/1998 | Shively | 343/895 |
| 5,870,057 | 2/1999 | Evans et al. | 343/700 MS |

OTHER PUBLICATIONS

Jaffe, "A High–Frequency Variable Delay Line", IEEE Transactions on Electron Devices, Dec. 1972 pp. 1292–1294.

Ogawa, et al., "Slow–Wave Characteristics of Ferromagnetic Semiconductor Microstrip Line", IEEE Transactions on Microwave Theory and Techniques, vol. MTT–34, Nov. 12, Dec. 1986, pp. 1478–1482.

Mu, et al., "Characteristics of Multiconductor, Asymmetric, Slow–Wave Microstrip Transmission Lines", IEEE Transactions on Microwave Theory and Techniques, vol. MTT–34, No. 12, Dec. 1986, pp. 1471–1477.

Hasegawa, et al., "Properties of Microstrip Line on Si–$SiO_2$ System", IEEE Transactions on Microwave Theory and Techniques, vol. MTT–19, No. 11, Nov. 1971, pp. 869–881.

Hasegawa, et al. "M.I.S. and Schottky Slow–Wave Coplanar Striplines on GaAs Substrates", Electronics Letters, 27$^{th}$ Oct. 1977, vol. 13, No. 22, pp. 663–664.

T.E. Morgan, "Spiral Antennas for ESM", IEEE Proceedings, Part F. vol. 132, pp. 245–251, Jul. 1985.

Mosko, et al., "An Introduction to Wideband, Two–Channel Direction Finding System, Part I", Microwave Journal, pp. 91–106, Feb. 1984.

Morgan, "Reduced Size Spiral Antenna", Proceedings of 9$^{th}$ European Microwave Conference, Sep. 1979, pp. 181–185.

Cubley, et al., "Radiation Field of Spiral Antennas Employing Multimode Slow Wave Techniques", IEEE Transactions on Antennas and Propagation, Jan. 1971, pp. 126–128.

*Primary Examiner*—Tan Ho

*Attorney, Agent, or Firm*—Thomas, Kayden, Horstemeyer & Risley LLP

[57] ABSTRACT

Disclosed is a broadband, miniaturized, slow-wave antenna for transmitting and receiving radio frequency (RF) signals. The slow-wave antenna comprises a dielectric substrate with a traveling wave structure mounted on one surface, and a conductive surface member mounted on the opposite surface. The traveling wave structure, for example, is of the broadband planar type such as various types of spirals and includes conductive arms which are coupled to feed lines which are routed through the dielectric substrate and the conductive surface member for connection to a transmitter or receiver. The dielectric substrate is of a predetermined thickness which is, for example, less than $0.04\lambda_1$, where $\lambda_1$ is the free space wavelength of the lowest frequency $f_1$ of the operating frequency range of the slow-wave antenna. Also, the dielectric constant of the dielectric substrate and the conductivity of the surface member are specified, along with the thickness of the dielectric substrate to ensure that a slow-wave launched in the traveling wave structure is tightly bound to the traveling wave structure, but not so tightly bound as to hinder radiation at a radiation zone of the traveling wave structure, while minimizing any propagation loss. The slow-wave antenna has a reduced phase velocity, which reduces the diameter of the radiation zone and, consequently, reduces the diameter of the slow-wave antenna.

14 Claims, 4 Drawing Sheets

BROADBAND MINIATURIZED SLOW-WAVE ANTENNA

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention is generally related to radio frequency antennas and, more particularly, is related to a broadband, miniaturized, slow-wave antenna.

BACKGROUND OF THE INVENTION

Currently, it is desirable to have small antennas with broadband and/or multi-band transmitting and receiving capabilities for telecommunications and other applications. In particular, such antenna structures are preferably miniaturized and in the shape of a thin disk or other similar planar structure for mounting, for example, on cellular telephones, microcomputers, vehicles, or other equipment.

One well-known and widely used antenna which, at least to some extent, meets the foregoing requirements and, consequently, has been deemed by many to be a possible candidate for such applications is a microstrip patch antenna. However, microstrip patch antennas generally suffer from narrow bandwidth and relatively large size as measured by the operating wavelength of such devices. Researchers have attempted to reduce the size of microstrip patch antennas while, at the same time, expanding their bandwidth with little success.

In addition, generally, electrically small antennas, which are defined to be antennas that can be enclosed in an electrically small volume measured by their operating wavelength, are inherently limited in their gain bandwidth. Such antennas invariably exhibit low directivity or a broad beamed radiation pattern such as an omni-directional antenna epitomized by a short dipole. Consequently, such antennas have a low gain since $$[\text{Antenna Gain}]=[\text{Efficiency}]\times[\text{Directivity}]$$

where the efficiency of the antenna includes the effect of dissipative losses due to the lossy properties of practical conducting and dielectric materials of which such antennas are constructed, and the effect of losses due to any impedance mismatch with respect to the antenna feed line. The antenna efficiency is generally always less than 100% since the construction materials are inevitably lossy, and the impedance matching is virtually always imperfect, especially over a wide frequency bandwidth.

It is worth noting that in practice, an electrically small antenna is often said to have a low gain referring to the fact that it has a low efficiency. A relatively high efficiency is necessary when the antenna is employed to transmit a signal, or is employed in broadcasting and two-way telecommunications. For further review, these concepts are discussed in books such as K. Fujimoto, A. Henderson, K. Hirasawa, and J. R. James, *Small Antennas,* Research Studies Press, Letchworth, Hertfordshire, England, 1987; and K. Fujimoto and J. R. James, ed., *Mobile Antenna Systems Handbook,* Artech House, Boston, 1994.

Efforts to reduce the size of the antenna by slow-wave (SW) techniques have been very unsuccessful resulting only in marginal reduction in antenna size.

Due to the foregoing limitations, research to develop compact high-efficiency disk-shaped antennas for broadband and/or multiband operation has met with limited success. While other electronic devices have seen a dramatic reduction in size, most notably integrated circuits and the like, antenna size reduction has been an extremely difficult technological barrier to overcome. Further, this barrier is currently one of a relatively few technological barriers for wireless telecommunications and other wireless systems.

SUMMARY OF THE INVENTION

The present invention provides for a broadband, miniaturized, slow-wave (SW) antenna for transmitting and receiving radio frequency (RF) signals ranging from ultra-low frequencies to millimeter wave frequencies. The slow-wave antenna comprises a dielectric substrate with a traveling wave structure (TWS) mounted on one surface, and a conductive surface member mounted on the opposite surface. The traveling wave structure belongs to the class of planar "frequency-independent" antennas such as, for example, an Archimedian spiral.

According to the preferred embodiment, a traveling wave structure is employed in the form of an Archimedian spiral having conductive arms that are coupled to feed lines which are routed through the center of the conductive surface member and the dielectric substrate. The dielectric substrate is of a predetermined thickness which is less than $0.04\lambda_1$, where $\lambda_1$ is a free space wavelength of the lowest frequency $f_1$ of the operating frequency range of the slow-wave antenna. Also, the dielectric constant of the dielectric substrate and the conductivity of the conductive surface member are specified, along with the thickness of the dielectric substrate, to ensure that a slow-wave (SW) launched in the traveling wave structure is tightly bound to the traveling wave structure, but not so tightly bound as to hinder radiation at the radiation zone of the traveling wave structure, while the propagation loss of the slow-wave is minimized. The radiation zone is a circumferential ring of small width at which the radiation effectively takes place so that the antenna can be approximately represented by currents at the radiation zone as far its far-field radiation is concerned.

The slow-wave antenna provides a distinct advantage in that it features a slower phase velocity and, consequently, a smaller radiation zone which, in turn, allows the diameter of the slow-wave antenna to be reduced significantly. Otherwise the slow-wave antenna would require a much larger diameter to accommodate the traveling wave structure with a phase velocity equal to that of light through free space. Consequently, the slow-wave antenna of the present invention is properly characterized as a miniaturized, broadband antenna as it can radiate and receive signals over a wide operating bandwidth, and yet the slow-wave antenna features a very compact size. The reduction in size is proportional to the degree of slowing of the slow-wave, as measured by the slow-wave factor which is defined as the ratio of the phase velocity of the propagating wave in the traveling wave structure to the speed of light in a vacuum.

In addition, the substantially flat and conformal shape of the slow-wave antenna makes it suitable for mounting on and integrating into the surface of equipment and vehicles that are planar or non-planar.

Other features and advantages of the present invention will become apparent to one with skill in the art upon examination of the following drawings and detailed description. It is intended that all such additional features and advantages be included herein within the scope of the present invention.

BRIEF DESCRIPTION OF THE SEVERAL VIEWS OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE INVENTION

The Physical Structure

Figure 1A:
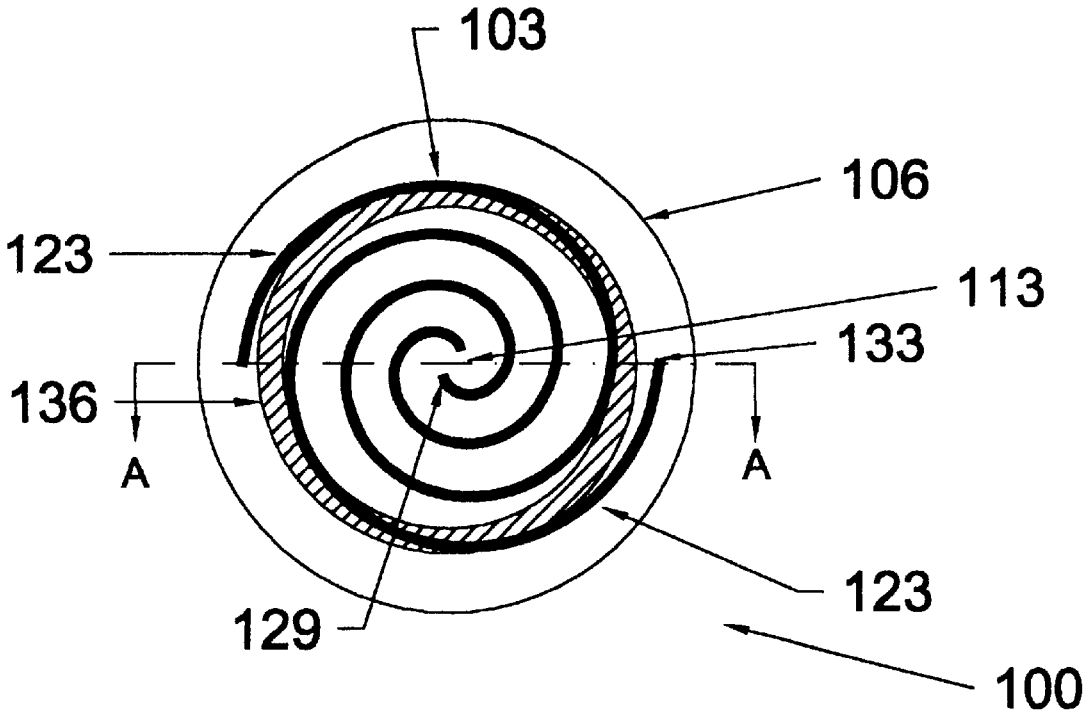
FIG. 1A is a top view of a slow-wave antenna according to an embodiment of the present invention.
Figure 1B:
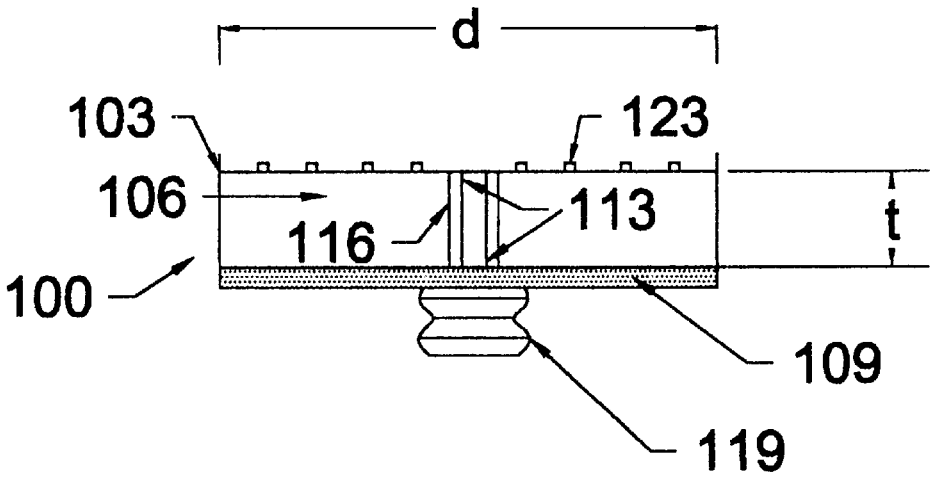
FIG. 1B is a cross-sectional view taken at an A—A plane of the slow-wave antenna of FIG. 1A.

Turning to FIGS. 1A and 1B, shown is a top view and a cross-sectional view of a slow-wave antenna 100 according to an embodiment of the present invention. In FIG. 1A, a traveling wave structure (TWS) 103 is shown disposed on a first surface of a dielectric substrate 106 having a predetermined complex dielectric constant. The cross-sectional view of FIG. 1B is taken at the cross section line A—A in FIG. 1A. The cross-sectional view of FIG. 1B depicts the slow-wave antenna 100 with the TWS 103 disposed on the first surface of the dielectric substrate 106. A conductive surface member 109 is disposed on a second surface of the dielectric substrate 106 opposite the TWS 103. The dielectric substrate 106 and the conductive surface member 109 have a diameter d. A predetermined number of feed lines 113 are coupled to the traveling wave structure, the feed lines 113 running through the center of the dielectric substrate 106 and the conductive surface member 109. The feed lines 113 are surrounded by a feed line shield 116. The feed lines 113 are coupled to a connector 119 which is configured to be coupled to a transmitter/receiver.

The TWS 103 as shown in FIG. 1A is, for example, an archimedian spiral with two conductive arms 123. Although an archimedian spiral is shown, the TWS 103 is generally a broadband planar traveling wave structure which may be comprised of other configurations such as a log-periodic structure or a sinuous antenna structure, etc., the archimedian spiral being shown to facilitate the discussion of the various embodiments of the invention herein. Note that further discussion of different types of planar broadband traveling wave structures 103 which may be employed herein are described in the literature as so called "frequency-independent antennas". For further information regarding alternative traveling wave structures 103, consult V. H. Rumsey, *Frequency Independent Antennas,* Academic Press, New York, N.Y., 1966. Also, the TWS 103 is comprised of conductive material such as metal.

The TWS 103 is coupled to and impedance matched to the feed lines 113 at its center. In the case of the archimedian spiral TWS 103 as shown, each feed line 113 is coupled to a proximate end 129 of a single conductive arm 123 of the TWS 103 at the center thereof, while the distal ends 133 of the conductive arms 123 lay at the outer edge of the TWS 103. Although only two conductive arms 123 and two feed lines 113 are shown, it is understood that there may be any number of conductive arms 123 and associated feed lines 113.

The feed lines 113 are surrounded by the feed line shield 116 which is preferably a conductive cylindrical tube for efficient transmission of the RF signal. Although the feed line shield 116 is shown as cylindrical in shape, it is understood that the feed line shield 116 may be a metallic material of any shape. The feed line shield 116 may be constructed from metals such as aluminum, brass, or other similarly suitable metals. Also, the feed lines 113 may be constructed from metals and in various shapes that are efficient for wave transmission. Although the feed lines 113 are shown as coupled to the proximate ends 129 of the conductive arms 123, it is understood that the feed lines 113 may be coupled to the distal ends 133 as well, or, at other points along the traveling wave structure 103 as discussed in U.S. Pat. No. 5,621,422 entitled "Spiral-Mode Microstrip (SMM) Antennas and Associated Methods for Exciting, Extracting and Multiplexing the Various Spiral Modes", issued on Apr. 15, 1997 to Wang, which is incorporated herein by reference.

Generally, the diameter of the dielectric substrate 106 may be greater than or equal to the diameter of the TWS 103. The dielectric substrate 106 has a predetermined thickness t which is determined as detailed in the following discussion. Also, the conductive surface member 109 comprises a material with a predetermined finite conductivity, including both conductors and semiconductors, as will be discussed.

The Operation of the Slow-Wave Antenna

Next, the general operation of the SW antenna 100 is discussed. Without loss of generality, we will focus on the case of a transmit antenna, with the discussion being applicable to the case of a receive antenna on the basis of the reciprocity theory. A radio-frequency (RF) signal is routed from a transmitter through the connector 119 and the feed lines 113 where it is launched into the conductive arms 123 with proper impedance matching as a slow-wave in the center of the TWS 103. The slow-wave begins to propagate along the conductive arms 123 of the TWS 103 in slot-line, multiple-slotline, or coplanar waveguide mode, etc. It is a characteristic of the slow-wave antenna 100 that the slow-wave is tightly bounded to the TWS until it reaches a radiation zone 136. The radiation zone 136 is a circumferential ring of a small width at which the radiation effectively takes place so, for purposes of far-field radiation, the slow-wave antenna 100 can be approximately represented by the radiation zone 136. The slow-wave advantageously allows the reduction of the diameter of the radiation zone 136 so that the diameter of the slow-wave antenna 100 is effectively reduced as will be discussed in detail, the reduction in size being proportional to the reduced phase velocity of the slow-wave in relation to the speed of light. Thus, the slow-wave antenna 100 is characterized by a slow-wave factor (SWF) which is defined as the ratio of the phase velocity Vs of the propagating wave in the TWS 103 to the speed of light c, given by the following relationship $$SWF=c/V_S=\lambda_0/\lambda_S$$

where c is the speed of light, $\lambda_0$ is the wavelength in free space at an operating frequency $f_0$, and $\lambda_S$ is the wavelength of the slow-wave at the operating frequency $f_0$. Note that the operating frequency $f_0$ remains the same both in free space and in the slow-wave antenna 100.

To explain further, the radiated electric field of any antenna, including the traveling wave structure 100, is given by the integral equation $$E(r)=\int_S[-j\omega\mu_o\{n'\times H(r')\}g(r;\ r')+\{n'\times E(r')\}\times\nabla' g(r;\ r')+\{n'\cdot E(r')\}]\nabla' g(r;\ r')ds'.$$

According to the above equation, the electric field intensity E(r) at a field point r in a far zone is a function of the fields E(r') and H(r') at the source point r' in the source region of the surface S enclosing the antenna. This mathematical expression is equivalent to Huygens' principle, which states that a wave front at a point can be considered as a new source of radiation. However, for antenna radiation to be effective, the radiated fields at r due to individual sources at points r' over the antenna should have a fairly uniform phase so that their cumulative effects lead to maximum field intensity with minimal phase cancellation among them.

For example, in the TWS 103 employing an archimedian spiral, this maximum field intensity occurs for a particular propagating frequency $f_P$ at a radiation zone 136 (the shaded area in FIG. 1A) which is comprised of a circular band with a circumference of $m\lambda_P$, where m is the mode of operation of the antenna (an integer), and $\lambda_P$ is the propagating wavelength. That is to say, a traveling wave launched at the center of the traveling wave structure 103 propagates along the TWS 103 until it reaches the radiation zone 136, where it radiates into free space.

Note that in the TWS 103, there may be different modes of operation and the slow-wave antenna 100 is preferably designed to operate in one or two modes. For example, in the case of the archimedian spiral as shown in FIG. 1A, a first mode and a second mode which radiate in unidirectional and omni-directional patterns, respectively, are generally employed for different applications. Thus, high-frequency waves having a smaller wavelength have a radiation zone 136 that is closer to the center of the traveling wave structure than low-frequency waves. By the same token, low-frequency waves with a larger wavelength have a radiation zone 136 that is closer to the outer circumference of the traveling wave structure. In other words, during transmission, low-frequency waves travel further in the traveling wave structure before they are radiated into free space. The opposite is true for high-frequency waves. This discussion on the size of the radiation zone 136 with respect to frequency is also valid for the receive case by way of the reciprocity theorem.

Explained in another way, the diameter of the TWS 103 should be large enough to accommodate the radiation zone 136 to allow efficient radiation for the lowest frequency $f_1$ in the operating bandwidth. According to the present invention, the diameter of the TWS 103 is decreased by reducing the diameter of the radiation zone 136. Since the radiation zone 136 is determined by the phase velocity of the slow-wave in the TWS 103, any reduction of the phase velocity of the traveling wave results in a corresponding reduction of the diameter of the radiation zone 136 for a specific frequency. The amount of reduction of the radiation zone 136 is proportional to the slow-wave factor SWF for the specific propagation frequency. The reduction of the radiation zone 136 advantageously allows the diameter of the TWS 103 to be decreased. Thus, a TWS 103, and correspondingly, the slow-wave antenna 100 can be miniaturized by a factor equal to its slow-wave factor SWF. For example, a slow-wave antenna 100 with a slow-wave factor SWF of three would reduce its physical size to one-third its ordinary size.

In other words, since the wavelength $\lambda_S$ is smaller than the wavelength $\lambda_0$ of the same signal at the same frequency in free space, then the distance the slow-wave travels along the conductive arms 123 is correspondingly less whether applied to the conductive arms 123 from the feed lines or induced onto the conductive arms 123 by an impinging electromagnetic wave.

Consequently, a TWS 103 such as an archimedian spiral, for example, which employs the slow-wave concepts discussed herein may be much smaller in size, as a miniaturized antenna, while maintaining substantially the broadband characteristics of a counterpart antenna in which the phase velocity is the velocity of light in free space c, where the two corresponding traveling wave structures are proportional in size according to the slow-wave factor SWF. In particular, the smaller radiation zone for lower frequencies in a slow-wave antenna according to the various embodiments translates into a smaller diameter for the TWS 103. In addition to the desired reduction in size, the slow wave antenna 100 features an additional advantage in that a desired radiation pattern is achieved. For example, the mode-1 unidirectional pattern is employed for conformal mounting of the slow wave antenna 100 on various equipment, including for example, a vehicle, and for minimizing any potential radiation hazard to the human body when the slow-wave antenna 100 is used on a portable system such as, for example, a hand-held cellular telephone.

In order to launch and sustain the propagation of a slow-wave through the TWS 103, it is important that the slow-wave be "tightly bound" to the TWS 103. That is to say, the physical parameters of the slow-wave antenna 100 are specified to ensure that the slow-wave for a specific frequency does not radiate from the TWS 103 before reaching the radiation zone. This is especially important for the case at lower frequencies at which the radiation zone determines the needed minimum size for the slow-wave antenna 100.

Referring back to FIG. 1A, the first of these physical parameters discussed is the thickness t of the dielectric substrate 106, which is specified to be less than $0.04\lambda_1$, where $\lambda_1$ is a free space wavelength of the lowest frequency $f_1$ of the slow-wave antenna 100. That is to say, the operating frequency range has a low frequency boundary at $f_1$ with a corresponding wavelength of $\lambda_1$, and a high frequency boundary $f_h$ with a corresponding wavelength of $\lambda_h$.

When the conductive surface member 109 is placed in such close proximity to the TWS 103, the effect is that the slow-wave which propagates through the conductive arms 123 is tightly bound to the TWS 103. As a result, the slow-wave propagates through the conductive arms 123 until it reaches its radiation zone, where it radiates from the TWS 103 into the space above the TWS 103.

The dielectric substrate 106 is sufficiently thin so that no surface wave is launched that would spoil or disrupt the radiation pattern of the TWS 103. For example, when the dielectric substrate 106 is thicker than approximately $0.04\lambda_1$, then the traveling waves may move away from the TWS 103 and radiate in a much less constrained manner, rather than following along the conductive arms 123 at the slower phase velocity until the radiation zone is reached. The choice for an optimum thickness t need also take into consideration the efficiency, or gain, of the slow-wave antenna 100, which generally tends to reduce as the thickness t decreases.

In addition, according to one embodiment of the present invention, the slow-wave is tightly bound to the conductive arms 123 of the TWS 103 when the dielectric constant of the dielectric substrate 106 and the finite conductivity of the conductive surface member 109 are at predetermined values. Specifically, in one embodiment, the slow-wave is tightly bound to the conductive arms 123 when the dielectric constant of the dielectric substrate 106 is greater than or equal to 5 and the finite conductivity of the conductive surface member 109 is greater than or equal to $1\times10^7$ mho/meter. In another embodiment, the dielectric constant of the dielectric substrate 106 is less than or equal to 2.5 and the conductivity of the conductive surface member 109 is finite, being less than or equal to $1\times10^7$ mho/meter, including semiconductors. The propagation velocity slows down because of the activities of energy transfer between the dielectric substrate 106 and the conductive surface member 109. The interfacial polarization between the dielectric substrate 106 and the conductive surface member 109 increases the effective dielectric constant, and thus the slow-wave factor SWF. Also note that in the slow-wave antenna 100, almost all the active power is transmitted through the dielectric substrate 106, not the conductive surface member 109. Consequently, the poor conductivity of the conductive surface member 109 does not contribute significantly to the energy dissipation.

The above values for the thickness t of the dielectric substrate, the conductivity of the conductive surface member 109, and the dielectric constant of the dielectric substrate 106 are chosen according to two basic criteria: (1) the slow-wave is tightly bound to the TWS 103, but not so tightly bound as to hinder radiation at the radiation zone, and (2) the propagation loss is minimized by a proper choice of a range of conductivity for the conductive surface member 109.

Note that the dielectric substrate 106 is in direct contact with the TWS 103. The TWS 103 may also be embedded into the dielectric substrate 106. Also, although the diameter of the conductive surface member 109 is shown to be equal to the diameter of the TWS 103, the diameter of the conductive surface member 109 is preferably larger than that of the TWS 103. However, the diameter of the conductive surface member 109 may also be slightly smaller than the diameter of the TWS 103.

In addition, reactive loading may be employed to improve impedance matching, thereby further reducing the diameter of the slow-wave antenna 100 while maintaining adequately high transmission efficiency necessary for use as a transmit/receive antenna. In particular, shorting pins (not shown) may be placed at optimum locations between adjacent conductive arms 123, or between the conductive arms 123 and the conductive surface member 109 to obtain any needed capacitive and inductive reactances. Lumped capacitive elements may also be employed.

The slow-wave antenna 100 as shown in FIG. 1A is a planar structure. It is understood that the slow-wave antenna 100 may be incorporated in a non-planar structure so as to facilitate mounting of the antenna onto any smooth curved surface. However, in such non-planar applications, the TWS 103 and the conductive surface member 109 should be substantially parallel to each other, with a non-planar dielectric substrate of uniform thickness t between them. Note that the slow-wave antenna 100 may also be non-circular in shape as well.

The slow-wave antenna 100 provides a distinct advantage due to its reduced size and broad bandwidth. Specifically, as an example, a slow-wave antenna 100 with a TWS 103 having a diameter of 1 inch features a bandwidth from 1.7 to 2.0 GHz, which is an 18% bandwidth. In order to achieve the same bandwidth according to a prior art spiral with a slow-wave factor SWF of 1, a diameter of at least 2.5 inches is necessary. In further comparison, a microstrip patch antenna with a 1 inch square can achieve a bandwidth of only 1% or less. The actual parameters chosen for a slow-wave antenna 100 including the diameter of the TWS 103, the dielectric constant of the dielectric substrate 106, and the conductivity for the conductive surface member 109 may ultimately depend upon the specific application for which the slow-wave antenna 100 is designed subject to the principles discussed above.

Alternative Variations

Figure 2A:
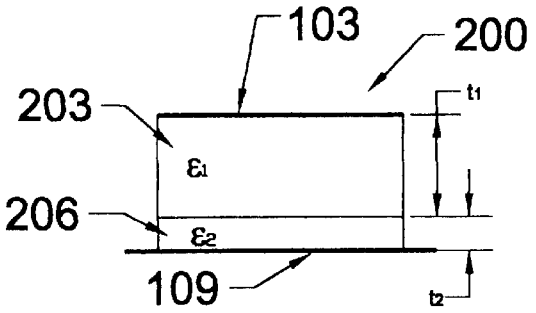
FIG. 2A is a cross-sectional view of a slow-wave antenna according to a second embodiment of the present invention.

Turning to FIG. 2A, shown is a cross-sectional view of a slow-wave antenna 200 according to a second embodiment of the present invention. The slow-wave antenna 200 includes the TWS 103 and the conductive surface member 109 as discussed with reference to FIGS. 1A and 1B. The slow-wave antenna 200 further includes a first dielectric substrate 203 and a second dielectric substrate 206 between the TWS 103 and the conductive surface member 109. The first dielectric substrate 203 has a predetermined thickness $t_1$ and a complex dielectric constant $\epsilon_1$. The second dielectric substrate 206 has a predetermined thickness $t_2$ and a complex dielectric constant $\epsilon_2$. According to the second embodiment, the predetermined thickness $t_1$ and the complex dielectric constant $\epsilon_1$ are much larger than predetermined thickness $t_2$ and the complex dielectric constant $\epsilon_2$, respectively. Both the complex dielectric constants $\epsilon_1$ and $\epsilon_2$ are greater than or equal to $\epsilon_0$, which is the dielectric constant of free space.

Figure 2B:
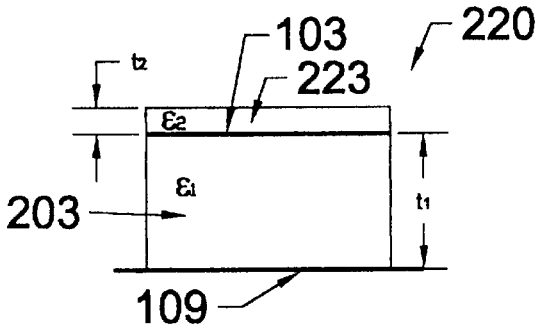
FIG. 2B is a cross-sectional view of a slow-wave antenna according to a third embodiment of the present invention.

Referring next to FIG. 2B, shown is a cross-sectional view of a slow-wave antenna 220 according to a third embodiment of the present invention. The slow-wave antenna 220 is similar to the slow-wave antenna 100 or 200, with the addition of a dielectric superstrate 223 on top of the TWS 103 of either FIG. 1 or FIG. 2A. The dielectric superstrate 223 has a predetermined thickness $t_2$ and complex dielectric constant $\epsilon_2$. The thickness $t_2$ and the dielectric $\epsilon_2$ may be greater or lesser than $t_1$ and $\epsilon_1$, respectively. The dielectric superstrate 223 further enhances the performance of the slow-wave antenna 220.

Figure 2C:
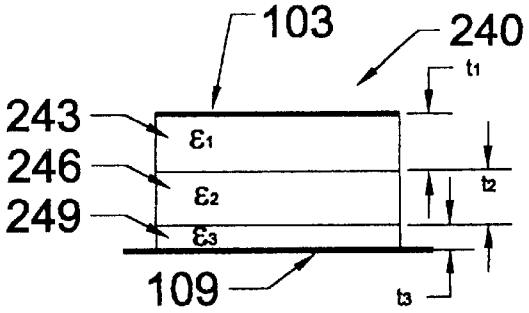
FIG. 2C is a cross-sectional view of a slow-wave antenna according to a fourth embodiment of the present invention.

With reference to FIG. 2C, shown is a cross-sectional view of a slow-wave antenna 240 according to a fourth embodiment of the present invention. The slow-wave antenna 240 includes the TWS 103 and the conductive surface member 109 as discussed with reference to FIGS. 1A and 1B. Between the TWS 103 and the conductive surface member 109, the slow-wave antenna 240 includes a first substrate 243 with a predetermined thickness $t_1$ and complex dielectric constant $\epsilon_1$, a second substrate 246 with a predetermined thickness $t_2$ and a complex dielectric constant $\epsilon_2$, and a third dielectric substrate 249 with a predetermined thickness $t_3$ and a complex dielectric constant $\epsilon_3$ as shown. The first and third dielectric substrates 243 and 249 are in contact with the TWS 103 and the conductive surface member 109, respectively. The slow-wave antenna 240 employs the multiple dielectric substrates 243, 246, and 249 to taper or step the complex dielectric constant from a higher value to a lower value between the TWS 103 and the conductive ground plane 109. Note that these multiple dielectric substrates 243, 246, and 249 can be viewed as dielectric substrate layers. Although only three dielectric substrate layers are shown, note that any number of dielectric substrate layers may be employed in the same manner as the three shown. Other combinations for the predetermined thicknesses $t_1$, $t_2$, and $t_3$ and the complex dielectric constants $\epsilon_1$, $\epsilon_2$ and $\epsilon_3$ may also be configured to enhance certain performance characteristics of the slow-wave antenna 240.

Experimental Results

Referring back to FIGS. 1A and 1B, to illustrate the effectiveness of a slow-wave antenna 100 according to the present invention, a comparison was performed between a prior art spiral antenna (with a SWF=1) and a slow-wave antenna 100 according to the present invention. Both the prior art spiral antenna (not shown) and the slow-wave antenna 100 included an archimedian spiral with a diameter of 1 inch.

First the test of the prior art spiral antenna is discussed. The prior art antenna did not include a dielectric substrate 106, thereby resulting in a slow-wave factor SWF of approximately 1. The thickness of the prior art antenna was specified to be approximately 0.155 inch, thus making this antenna suitable for transmission in the L-band. Regarding the prior art antenna tested, it is well known that a spiral antenna with a diameter of 1 inch rapidly loses its ability to support mode-1 radiation at frequencies below 3.75 GHz since its circumference drops to less than 1 wavelength below 3.75 GHz, therefore failing the radiation zone requirement. (At 3.75 GHz, wavelength=3.15 inches.) That is, at frequencies below 3.75 GHz, the radiation zone is larger than the prior art antenna itself.

Figure 3A:
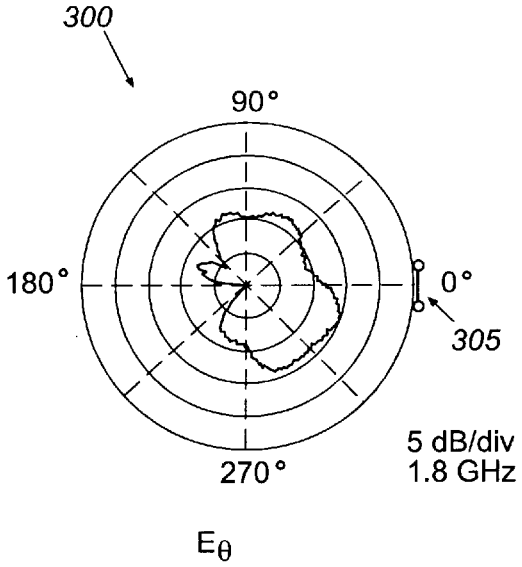
FIG. 3A is a graph of a measured radiation pattern for the θ-polarized component of a prior art antenna with a slow wave factor of 1.
Figure 3B:
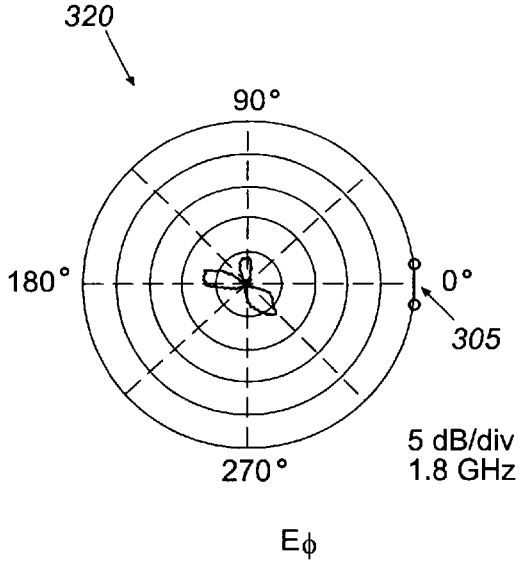
FIG. 3B is a graph of a measured radiation pattern for the ϕ-polarized component of a prior art antenna (SWF=1)

Referring to FIGS. 3A and 3B, shown are measured radiation patterns 300 and 320 for the θ-polarized and ϕ-polarized components at a frequency of 1.8 GHz for the prior art spiral antenna (SWF=1) with 5 dB/div. On both the radiation patterns 300 and 320 is a reference level mark 305 which is used as a reference level for the comparison performed. As is seen, the radiation patterns 300 and 320 of the θ-polarized and ϕ-polarized components are well below the reference level mark 305. The examples of the measured patterns in FIGS. 3A and 3B show that there is no significant mode-1 radiation for this prior art spiral antenna. Any radiation in the boresight direction that might suggest a small mode-1 radiation is probably attributable to stray radiation and scattering from the feed cable, antenna mounting tower, the anechoic chamber, etc.

Figure 4A:
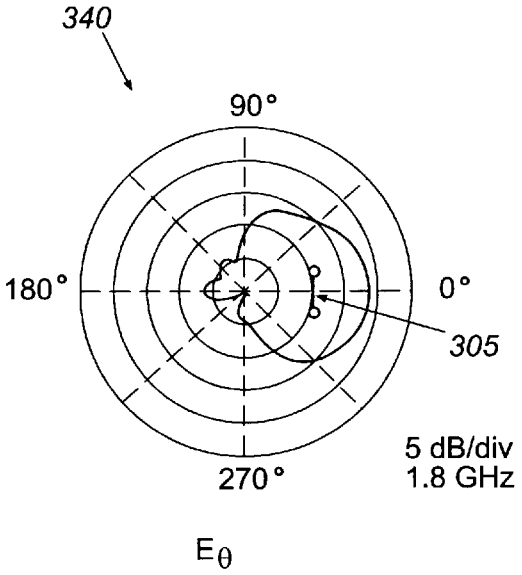
FIG. 4A is a graph of a measured radiation pattern for the θ-polarized component of a slow-wave antenna as described in FIGS. 1A and 1B.
Figure 4B:
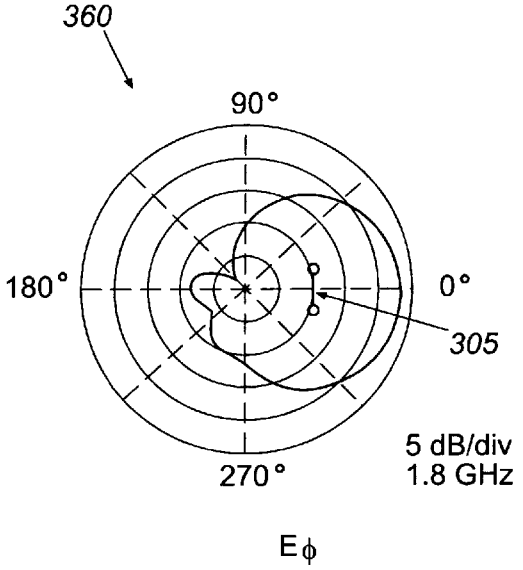
FIG. 4B is a graph of a measured radiation pattern for the ϕ-polarized component of a slow-wave antenna as described in FIGS. 1A and 1B.

Turning then, to FIGS. 4A and 4B shown are measured radiation patterns 340 and 360 with 5 dB/div. and reference level mark 305 for the θ-polarized and ϕ-polarized components at a frequency of 1.8 GHz for a slow-wave antenna 100 (FIGS. 1A and 1B). The slow-wave antenna 100 included a dielectric substrate 106 (FIGS. 1A and 1B) with a thickness t of 0.155 inches with an estimated complex relative permittivity of 10−j0.003, which corresponds to a loss tangent of 0.0003. Also, proper slotline excitation was employed to meet the slow-wave criteria. The measured patterns, as shown in FIGS. 4A and 4B exhibit clear, prominent mode-1 radiation at 1.8 GHz, as evidenced by their shape (strong boresight radiation) and intensity which is approximately 20 dB higher. Although only the 1.8 GHz pattern is shown, the low end of the operating frequency of the 1-inch spiral has actually been extended from 3.75 GHz to approximately 1 GHz, achieving a slow-wave factor SWF of approximately 4, which implies an effective dielectric constant of approximately 15, slightly higher than the dielectric constant of the dielectric substrate 106 which is approximately 10.

Figure 5:
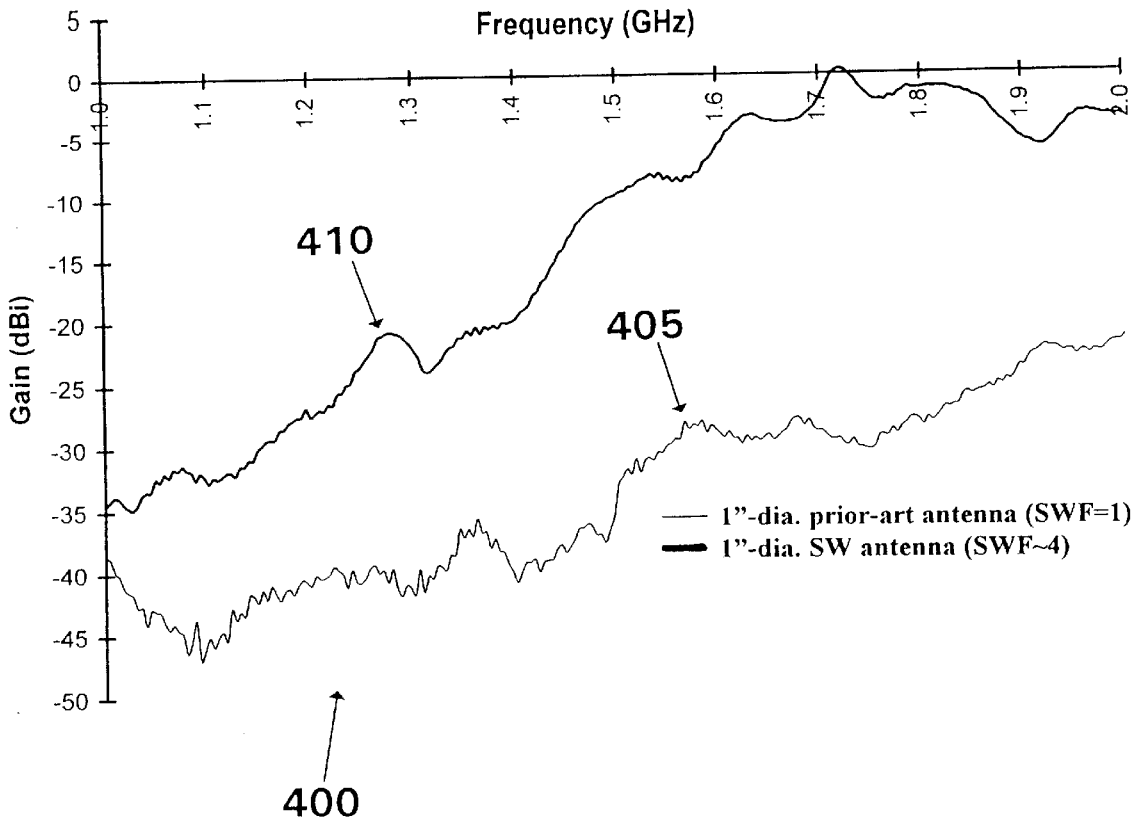
FIG. 5 is a graph of the measured gain of a prior art antenna (SWF=1) and the measured gain of a slow-wave antenna as described in FIGS. 1A and 1B.

Turning to FIG. 5, shown is a graph 400 depicting the prior art spiral antenna (SWF=1) gain 405 and the slow-wave antenna gain 410 on boresight, both gains being measured by calibrating against a standard-gain antenna. The graph depicts gain in dBi over a frequency range from 1–2 GHz. Overall, the slow-wave antenna gain 410 averages about 20 dB higher than that of the prior art antenna gain 405. The gain in both cases decreases rapidly with decreasing frequency largely due to the fundamental physical limitation of the antenna which says that the antenna gain necessarily decreases with decreasing frequency when the antenna is electrically small. This is a well recognized fundamental technological barrier that cannot be overcome. However, in this case some further improvement is still feasible by using reactive matching at the periphery of the TWS 100, as well as the manipulation of the conductivity of the TWS 100 and the conductive surface member 109.

Reactive loading was employed near the edge of the TWS 100, where energy in the lower frequencies in the operating band radiates, to improve impedance matching. The use of thin superstrates having the same properties as the dielectric substrate 106 on top of the spiral was shown to further enhance the performance of the slow-wave structure.

Many variations and modifications may be made to the above-described embodiment(s) of the invention without departing substantially from the spirit and principles of the invention. All such modifications and variations are intended to be included herein within the scope of the present invention.

Therefore, having thus described the invention, at least the following is claimed:

1. A miniaturized, slow-wave antenna, comprising:

a dielectric substrate having a first surface and a second surface;

a traveling wave structure disposed on the first surface of the dielectric substrate;

at least one feed line connected to the traveling wave structure;

a surface member having a finite conductivity disposed on the second surface of the dielectric substrate;

the dielectric substrate having an electrical thickness of less than or equal to $0.04\lambda_1$, where $\lambda_1$ is an operating wavelength in free space for a slow-wave given by $\lambda_1=c/f_1$, where c is a speed of light and $f_1$ is a lowest frequency of an operating frequency range of the slow-wave antenna; and the traveling wave structure and the dielectric substrate having a circumference at least as great as a radiation zone of the slow-wave antenna, the radiation zone comprising a circular band with a circumference $m\lambda_1$, where m is an integer specifying a mode of operation of the traveling wave structure.

2. The miniaturized, slow-wave antenna of claim 1, the traveling wave structure having a predetermined circumference that is less than $1.2\lambda_1$/SWF, where SWF is defined as a slow-wave factor of the slow-wave antenna, the slow-wave factor being defined as a ratio of a phase velocity of the slow-wave antenna to the speed of light in a vacuum.

3. The miniaturized, slow-wave antenna of claim 1, wherein a circumference of the dielectric substrate is at least as great as a circumference of the traveling wave structure.

4. The miniaturized, slow-wave antenna of claim 3, wherein a circumference of the surface member is no greater than the circumference of the dielectric substrate.

5. The miniaturized, slow-wave antenna of claim 3, wherein a circumference of the surface member is a least as great as the circumference of the dielectric substrate.

6. The miniaturized, slow-wave antenna of claim 1, further comprising:

said traveling wave structure having at least one conductive arm; and a plurality of reactive elements disposed on the conductive arm in the traveling wave structure, the reactive elements providing a reactive load for impedance matching.

7. The miniaturized, slow-wave antenna of claim 6, wherein the reactive elements further comprise a plurality of shorting pins disposed between the conductive arm and the surface member, the shorting pins providing a reactive load for impedance matching.

8. The miniaturized, slow-wave antenna of claim 6, wherein the reactive elements further comprise a plurality of shorting pins disposed between a first conductive arm and a second conductive arm in the traveling wave structure, the shorting pins providing a matching reactive load.

9. The miniaturized, slow-wave antenna of claim 1, wherein the conductivity of the surface member is greater than $1\times10^7$ mhos/meter and dielectric substrate having a dielectric constant greater than 5.

10. The miniaturized, slow-wave antenna of claim 1, wherein the conductivity of the surface member is less than $1\times10^7$ mhos/meter and dielectric substrate having a dielectric constant less than 2.5.

11. The miniaturized, slow-wave antenna of claim 1, wherein the traveling wave structure is comprised of at least two spiral arms.

12. The miniaturized, slow-wave antenna of claim 1, wherein the feed lines are connected to an outer edge of the traveling wave structure.

13. The miniaturized, slow-wave antenna of claim 1, further comprising a dielectric superstrate disposed on the traveling wave structure.

14. The miniaturized, slow-wave antenna of claim 1, wherein the dielectric substrate further comprises a plurality of dielectric substrate layers.

* * * * *